US006705613B1

(12) United States Patent
Wirth

(10) Patent No.: US 6,705,613 B1
(45) Date of Patent: Mar. 16, 2004

(54) METHOD AND APPARATUS FOR PLAYING CASINO POKER GAME

(76) Inventor: John E. Wirth, 10808 Depot - P.O. Box 400, Worth, IL (US) 60482

( * ) Notice: Subject to any disclaimer, the term of this patent is extended or adjusted under 35 U.S.C. 154(b) by 25 days.

(21) Appl. No.: 10/247,987

(22) Filed: Sep. 20, 2002

(51) Int. Cl.[7] ..... A63F 1/00
(52) U.S. Cl. ..... 273/274; 273/292; 273/309
(58) Field of Search ..... 273/292, 274, 273/309

(56) References Cited

U.S. PATENT DOCUMENTS

| | | | | |
|---|---|---|---|---|
| 3,667,757 A | | 6/1972 | Holmberg | 273/135 |
| 4,836,553 A | | 6/1989 | Suttle et al. | 273/292 |
| 4,861,041 A | | 8/1989 | Jones et al. | 273/292 |
| 5,078,405 A | | 1/1992 | Jones et al. | 273/309 |
| 5,098,107 A | | 3/1992 | Boylan et al. | 273/292 |
| 5,154,429 A | | 10/1992 | LeVasseur | 273/292 |
| 5,437,462 A | | 8/1995 | Breeding | 273/292 |
| 5,584,485 A | * | 12/1996 | Jones et al. | 273/292 |
| 5,597,162 A | * | 1/1997 | Franklin | 273/292 |
| 5,810,354 A | * | 9/1998 | Banyai | 273/292 |
| 5,845,906 A | * | 12/1998 | Wirth | 273/274 |
| 6,113,101 A | * | 9/2000 | Wirth | 273/274 |
| 6,179,293 B1 | * | 1/2001 | Hedman | 273/292 |
| 6,467,771 B1 | * | 10/2002 | deKeller | 273/274 |

* cited by examiner

*Primary Examiner*—William M. Pierce
(74) *Attorney, Agent, or Firm*—Marshall, Gerstein & Borun LLP

(57) ABSTRACT

A casino game, based on the rules of poker, wherein each player is dealt five cards, with an option to utilize a sixth card to improve the five-card hand. The game provides a player with three opportunities to win: 1) head-to-head competition against the dealer, with the higher poker hand winning; 2) competition for a common pot among the players, the amount of the pot increasing until a player has a hand of three-of-a-kind or better; and 3) bonus payments for long-odds hands (e.g., straight or better). Because no player has an opportunity to increase his/her wager during play, the game proceeds rapidly.

9 Claims, 1 Drawing Sheet

METHOD AND APPARATUS FOR PLAYING CASINO POKER GAME

BACKGROUND OF THE INVENTION

In U.S. Pat. Nos. 5,845,906 and 6,113,101, the text of which is incorporated by reference herein, I described methods for playing wagering games which were based, in substantial part, on the rules of poker. As was the case with these earlier disclosures, the present invention relates generally to a playing card wagering game which is particularly applicable to a casino environment in which multiple players compete with themselves and with the house. The game in its variations can also be played in a home environment.

Wagering games, particularly those intended primarily for play in casinos, should provide players with a sense of participation and control, the opportunity to make decisions, and reasonable odds of winning, even though the odds favor the casino, house, dealer or banker. The game must also meet the requirements of regulatory agencies.

Wagering games, including wagering games for casino play with multiple wagering opportunities, are known. In addition to the above-mentioned patents, U.S. Pat. Nos. 4,861,041 and 5,087,405 (both to Jones et al) disclose methods and apparatus for progressive jackpot gaming, respectively. The former patent discloses that a player may make an additional wager at the beginning of a hand, the outcome of the additional wager being determined by a predetermined arrangement of cards in the player's hand. U.S. Pat. No. 4,836,553 (to Suttle and Jones) discloses a modified version of a five card stud poker game.

Additional symbols may be added to the usual means of playing a game to increase wagering opportunities. This is disclosed in U.S. Pat. No. 5,098,107 (to Boylan et al). Somewhat similarly, U.S. Pat. No. 3,667,757 (to Holmberg) discloses a board game and apparatus, including a way to allow the player to make a choice with respect to several different alternative types of game play and risk-bearing strategies. The alternative play is based on providing cards with additional symbols and therefore, a new set of odds. The game and apparatus disclosed by Holmberg requires new sets of rules, relatively complicated procedures and time for a player to learn the game.

U.S. Pat. No. 5,154,429 (to LeVasseur) involves the dealer playing multiple hands against a player's single hand, whereby the number of hands played in the same amount of time is increased.

U.S. Pat. No. 5,437,462 (to Breeding) discloses a casino-type poker game wherein players are given an opportunity to withdraw at least a part of their bets before all the cards are dealt. The game employs at least one common card which can be used by all of the players.

SUMMARY OF THE INVENTION

The present invention relates to a card game, in particular to a card game suitable for use in casinos, and to tables for playing the game. The game combines the concepts of draw poker with simultaneous play against a dealer (the house) and play against other players. Players who are dealt premium hands receive bonus payments, depending on the value of the hand. Because the players are not permitted to increase their wagers, the game moves rapidly.

The game follows the rules of stud poker. Each player's poker hand is made from 5 dealt cards with the right to use a common card to improve the dealt hand if the player elects to discard and pay the house for the privilege of using this common card. The dealer has same option as other players, i.e., to make the best five-card hand from six cards; however, the dealer does not pay to use the common card. Each player plays head-to-head against the dealer for one part of the wager, and against the other players or another part of the wager (the "common pot" or "Players' Pot"). A bonus or "premium pot" provides the players with a third opportunity to win.

Premium or bonus pots have become very popular with the gaming public. This game incorporates a premium pot, but unlike conventional games (e.g., Caribbean Stud) where players contribute to the makeup of that pot, the present game has a bonus system which does not require a direct contribution by the players. In the present game, it is envisioned that a player having an extraordinary poker hand (e.g., a straight or higher) will receive a bonus or premium payment from the house, based on the statistical rarity of the hand. Funds to pay the bonus can be generated from the monies paid to the dealer (house) in the course of the game when players buy a card from the dealer. Although the amount or cost of the one card can be determined by the house, the suggested price in this game would be $5.00. Because premium payouts will not be an every-game occurrence, sufficient funds to seed and maintain this bonus pool can easily be obtained from amounts paid for extra cards over the course of many hands. Similarly, the funds required to seed the game as a tournament game can be obtained from amounts paid for extra cards.

The game would proceed as follows. The dealer (house) operates from a table playing station which provides easy access to the players. In addition to the dealer, the game can be played by as many as six players around the table, each operating from a playing station which has a card playing area and a betting area. Each player's betting area contains at least two wager zones: a first Ante zone, and a second zone for wagers which form the "Players' Pot." A player's playing area might also contain a marked region or regions for placing a discarded card and for paying the dealer for the right to make such a discard. The players' stations also contain regions or zones where cards can be dealt.

The dealer's playing station is somewhat different than that of the players. In addition to a region or zone for placing the five cards dealt to the dealer, the dealer's playing station contains a zone for placement of a common card which can be utilized by any of the players who opt to make a discard. The dealer's playing station also contains a region or zone for maintaining a common Players' Pot.

In a preferred method, play would commence as follows: Each player would place a predetermined amount in a first Ante zone at his/her station on the table. The suggested amount for an ante for this game would be $5.00 per hand in the Ante zone, although this amount is given for purposes of illustration only, and could be higher or lower at house discretion.

Five cards are dealt to each player, preferably all at one time, starting from the dealer's left to right; the dealer being dealt last. The dealer also places a single card in a "common card" zone region of the table. All cards—players', dealer's and the common card—are dealt face down. The players look at their five cards and determine if they are going to play. If a player is going to fold, he or she indicates this by discarding all five cards to the dealer. Dealer then picks up the ante wager in the player's first Ante zone and the five cards dealt to the folding player. The forfeited ante wager belongs to the house.

If a player opts to continue, he or she indicates this by placing a second wager (e.g., five dollars) in the second, "Players' Pot" zone at his/her playing station. At this point, the player has two options: standing pat, or discarding one card in the hopes of improving the hand by use of the as yet undisclosed common card. A player who opts to use the common card must place one of the dealt cards in a discard zone at his/her playing station, together with a payment to the dealer (e.g., $5.00) for the right to make this discard. In the next stage of play, the dealer would pick up the extra card payments and discards from each of the players who have opted to utilize the common card (viz., from all players except those who have opted to stand pat). As was the case with Ante wagers collected from players who have decided not to continue, the extra card payments go to the house. The justification for this situation will be explained below.

All cards returned to the dealer are placed in a discard area on the table. A preferred method would involve placing the discards in a holding area provided on the table, adjacent the dealer's playing station. As noted above, it is envisioned that the receipts from extra-card payments will off-set any payments the house may make to players who have poker hands of a certain value (e.g., a straight or above). Players having these types of hands (a "bonus" hand) are entitled to a bonus or premium in addition to any wagers they may recover from the dealer or from other players through the "Players' Pot."

At this point in the game, each of the remaining players will have two wagers on the table at his/her playing station—one wager in the Ante zone and a second wager in the Players' Pot zone. As will be described in greater detail below, the wager in the Ante zone represents a bet between the player and the dealer. The wager in the player's second or Players' Pot zone represents a bet with each of the remaining players, apart from the dealer. That is to say, except for a service charge or "rake" (described hereafter), the dealer is generally not eligible for any portion of the Players' Pot (with one exception, described below).

Although the dealer does not participate as a player, the house may be entitled to a portion of the Players' Pot as a service charge or "rake". A commonly-used rake for casino card parlors is 5% of the pot. The house "rake" in this case could be much smaller. A schedule of amounts to be "raked" could be: $1.00 for each $30.00 accumulated in the Players Pot; $1.50 for pots of $75.00, and so on (i.e., a 3.3% rake). This "rake" would be paid to the house when "players pot" is finely won by a player. If the Players Pot is under $25.00, no "rake" would be taken. These suggestions concerning the amount of the house "rake" are for illustration only, and variations could be made at the option of the house, including a decision to forgo any "rake."

With respect to the bet's placed on each player's "Players' Pot" zone, these wagers could either be left in place until completion of the current hand, or gathered by the dealer in the common Players' Pot region on the table to be combined with any previously-undistributed Players' Pot wagers.

When the dealer has finished with all players, he or she would turn over and expose the five cards which were dealt to the dealer. The dealer's subsequent actions are governed as follows: 1) If the dealer has a straight or better, the dealer stands pat, and may not discard and used the common card; 2) If the dealer has four cards to a flush, the dealer must discard the odd card, even if this results in breaking up a pair; 3) Similarly, if the dealer has four cards to a straight, he holds these cards, and discards the odd card, subject to the following rules: 3*a*) if the dealer has the choice between holding an open straight draw and an inside straight draw, he will hold the open straight draw; and, 3*b*) if the dealer has the choice between two inside straight draws, he will hold the higher of the two; 4) Finally, in all other cases, the dealer must discard the lowest unmatched card.

An example of situation 3*a* is as follows: if the dealer has the following dealt hand—3, 4, 5, 6, 8—he should discard the "8", because this gives him two possibilities (a "2" or a "7") to fill the straight; discarding the "3" would give him only one such possibility (a "7"). An example of situation 3*b* is the following—2, 3, 4, 6, 7. Although the dealer has only one possibility to improve this straight (a "5"), he should discard the "2" and not the "7" because a 7-high straight is better than a 6-high straight.

Stated mathematically, if "X" is the lowest value card in the hand which is initially dealt to the dealer, type 3*b* hands can be represented as: X+(X+1)+(X+2)+(X+4)+(X+5); or X+(X+1)+(X+3)+(X+4)+(X+5). In either situation, card X must be discarded by the dealer.

After the five cards dealt to the dealer have been exposed, and the dealer has made a discard (if required) in accordance with the above-outlined procedures, the dealer exposes the common card. Irrespective of this result, all dealer hands must play.

After the dealer's hand has been exposed, the dealer turns up each player's hand, starting from his left to right. The dealer pays an amount equal to the Ante wager in the first betting zone to each player who has a higher poker hand than the dealer, and collects the Ante bets from all of the players with lower hands than the dealer. In those situations where a player and the dealer have hands of the same value, these hands result in a "push", and no money is exchanged between the player and the dealer.

At this point in the game, the dealer would pay a bonus or premium to any player who holds a "bonus hand"—a poker hand comprising a straight or better. In a preferred embodiment, this bonus would only be paid to those players whose poker hands were higher than that of the dealer. For example, if the dealer's hand comprised a flush, no bonus would be paid to a player holding a straight.

As to the amount of the bonus, such payouts by the dealer could be based on the amount a player must pay to discard and use the "common" card. Suggested payouts based on this system are as follows:

| | |
|---|---|
| Straight | 3 to 1 |
| Flush | 5 to 1 |
| Full House | 7 to 1 |
| Four of a Kind | 15 to 1 |
| Straight Flush | 25 to 1 |
| Royal Flush | 50 to 1 |

Using the above table, and assuming that the right to discard and use the common card costs $5.00, a player holding a flush would be entitled to a bonus payment of $25.00. The foregoing system of payouts has been provided by way of example, only, and could be varied at the discretion of the house.

One final point about the bonus payout system. Although the payout system illustrated above is based on the amount charged for discarding a card, a player need not discard to be eligible for a bonus payment. For example, a player whose originally-dealt cards formed a straight, and who understandably opted to stand pat, would be entitled to a $15.00 bonus payment.

The final stage of play involves head-to-head competition between the players. Any player who has not folded will have anteed money into a second betting zone on the table. The wagers in this second zone, plus any previously-undistributed wagers from prior hands, form a common, Players Pot. This pot will be paid to the player who has the highest poker hand, provided that the hand must be three-of-a-kind or better. If more than one player has three-of-a-kind or better, the player with the highest poker hand will receive the Players' Pot. If no player has three-of-a-kind or better, the current hand's Players' Pot wagers are added to any previous wagers in the Common Players' Pot, and the pool continues to the next hand until someone obtains a hand of three-of-a-kind or better. As noted above, the dealer does not normally participate in the Players' Pot (apart from the house "rake").

In the event that a new player (i.e., an individual who has not previously placed an ante bet) would like to enter the game after a Players' Pot has started (i.e., while there are undistributed funds in the Common Players' Pot), he/she may do so by contributing an amount proportional to as many hands that have been played. For example, if three hands have been played, each current player who has not folded along the way will have contributed $15 to the Common Players' Pot (3×$5). A new player who wishes to enter the game at this juncture could do so by contributing $15 to the Common Players' Pot prior to the start of the next hand. If a new player does not want to make a contribution to the Common Players' Pot, his/her participation in the game is limited to head-to-head play against the house (including the right to receive bonus payments for straights or better) until the then-current common Players' Pot is won.

Lastly, there is one exception to the rule that the dealer is not eligible for the Common Players' Pot. In the event that only one player is at the table, the house may contribute an amount equal to $5 times y (where y is the number of previously-played hands without a Players' Pot payoff). This exception would only apply in the case where only one player is left at the table.

In summary, under the method described above, a player has three opportunities to win: 1) by having a higher poker hand in one-on-one play with the dealer; 2) by having the highest poker hand, three-of-a-kind or better, among all of the players at the table; and, 3) by having a "premium" or "bonus" hand (e.g., a straight or better) which entitles the player to a premium payout from the house. Operation of the game can be further understood with reference to the description of apparatus for playing the game.

Although certain apparatus constructed in accordance with the teachings of the invention is described herein, the scope of coverage of this patent is not limited thereto. On the contrary, this patent covers all embodiments of the teachings of the invention fairly falling within the scope of the appended claims either literally or under the doctrine of equivalents.

DETAILED DESCRIPTION OF A PREFERRED EMBODIMENT

Figure 1:
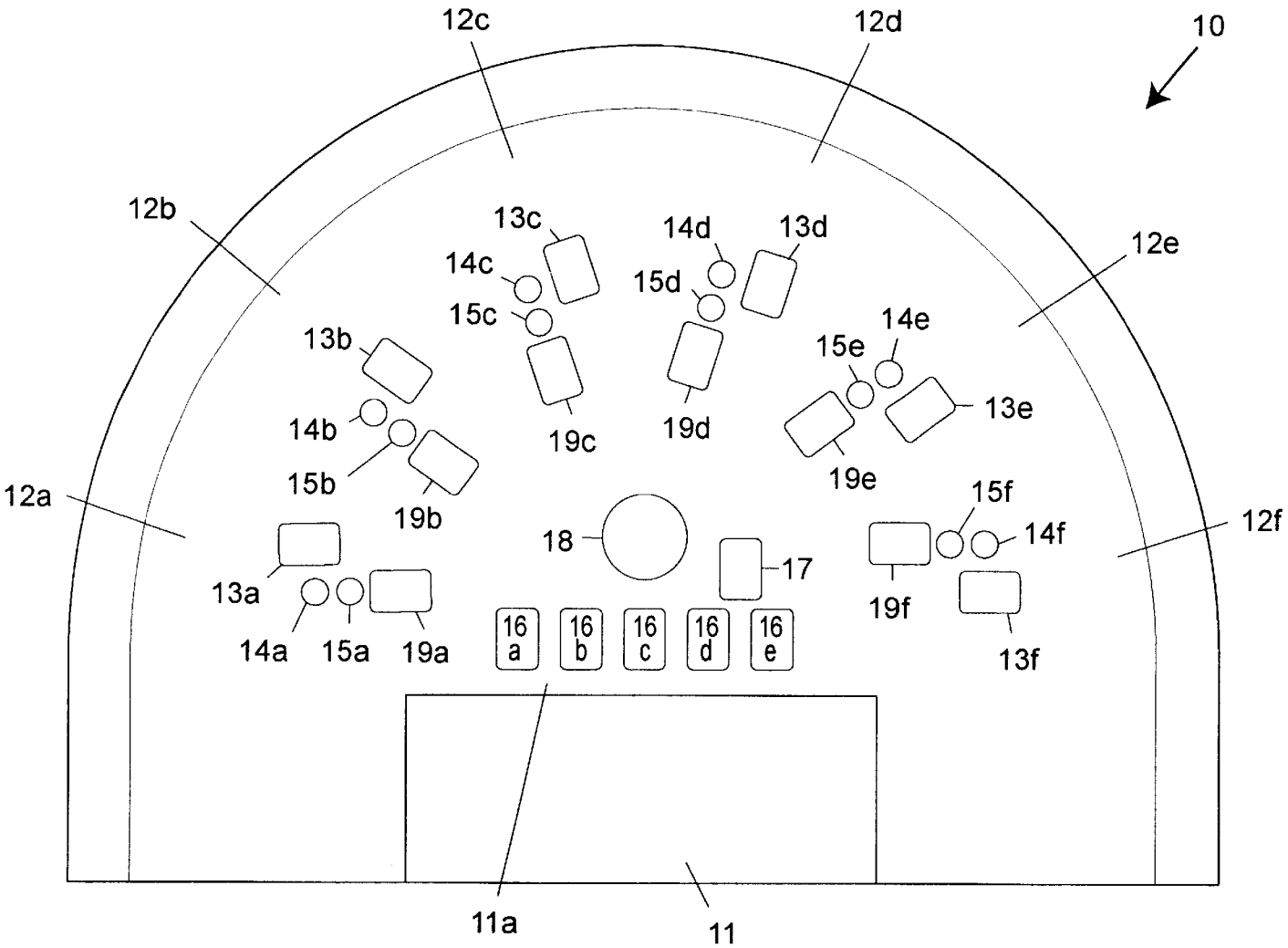
FIG. 1 is a plan view depicting a table which can be used for playing the casino poker game of the present invention.

Referring now to the drawing, FIG. 1 discloses a casino poker table at 10. Table 10 has a generally semi-circular shape and is provided with a recessed area 11 where a dealer can stand and have access to the cards and wagers of the players around the table. Immediately in front of recessed area 11 is a dealer's playing station 11*a* where the dealer's cards can be dealt.

Six player areas or playing stations 12*a*, 12*b*, 12*c*, 12*d*, 12*e* and 12*f* are disposed along the arcuate side of table 10, across from dealer station 11*a*. Each player's station 12*a* through 12*f* has corresponding player's card playing areas 13*a* through 13*f*, first betting zones 14*a* through 14*f*, second betting zones 15*a* through 15*f*, and discard areas 19*a* through 19*f*. Betting zones 14, 15 and discard areas 19 are defined by indicia on the top of table 10.

In front of dealer's playing station 11*a* is a dealer's card area 16*a*, 16*b*, 16*c*, 16*d*, 16*e* for display of dealer's initial five cards, and a separate card area 17 for display of a sixth (common) card. The region in front of the dealer also contains a Players' Pot zone 18 for holding chips or cash. Zone 18 could be labeled "Players Pot" to indicate its function.

As described in the preceding paragraphs, play commences by each player placing an Ante wager in first betting zone 14. In one embodiment of the invention, the dealer then deals five cards to each of the players who has made an ante wager, placing five of the dealt cards in each player's card playing area 13. Cards are dealt from dealer's left to right, five at a time. All cards, including those in dealer's area 16*a*, 16*b*, 16*c*, 16*d*, 16*e* and 17 are dealt in a face-down position. After inspection of their cards, players who decide to continue signify this fact by placing a second wager in second betting zone 15. Those players who opt not to play, will push the cards in zone 13 toward the dealer and will forfeit the wager in zone 14 to the dealer.

Any player desiring to improve his or her original hand may discard one card by placing it and an appropriate fee in his/her discard area 19, and utilize the sixth card at zone 17 as part of the hand. Any cards and wagers in player zones 19*a*–19*f* are collected by the dealer. In a preferred embodiment, the wagers in second betting zones 15*a*–5*f* would be moved by the dealer to Players' Pot zone 18.

Once each player has opted to stay or to fold, and has made a decision as to standing pat or using the sixth card at zone 17, play commences by the dealer turning the five cards in areas 16a–16*e* to a face-up position. Depending on the nature of the poker hand formed by the cards in area 16*a*–16*f*, the dealer may have the option of discarding and using the sixth card in area 17.

The dealer's hand is compared with the hands of each of the players, in turn. If a player has a higher-value poker hand than the dealer, the wager at zone 14 will be returned to the player, together with an equal amount from the dealer. If the player has a premium hand (as defined above), he or she will receive a bonus payment from the dealer. On the other hand, if a player's hand is lower in value than that of the dealer, the wager at zone 14 will be surrendered to the dealer.

Finally, if at least one of the players has a poker hand of three-of-a-kind or better, his or her hand will be compared with the hands of the other players and the funds in Players' Pot zone 18 (less the house rake) will be awarded to the player having the highest value hand. If no player has a hand of three-of-a-kind or better, the wagers in Players' Pot zone 18 will remain on the table and form part of the pot in the next hand.

Although a preferred embodiment has been described in detail, it should be understood that various changes and alterations can be made without departing from the spirit and scope of the invention.

What is claimed is:

1. A method of playing a modified draw poker game comprising:

providing a table having a playing station for a dealer and playing stations for a plurality of players, each player station comprising a card playing area;

betting areas on said table having first and second betting zones for each player;

each player placing a predetermined wager in said first betting zone;

the dealer dealing an initial, five-card hand, face down, to himself and to each player;

the dealer placing a common card, face down, at a location on the table;

providing an opportunity for each player to fold or stay, each player who folds forfeiting the wager in said first betting zone to dealer, and each player who stays placing a second wager in the player's second betting zone, said wagers in the second betting zone comprising a players' pot;

providing an opportunity for each player to discard one card and to utilize said common card to improve his or her poker hand;

turning all cards to a face up position:

(a) the dealer paying an amount equal to the wager in said first betting zone to each player who has a higher poker hand than dealer, and collecting the wagers in said first betting zone from each player having a lower poker hand than dealer;

(b) if one or more players has a poker hand whose value is three-of-a-kind or better, the dealer paying the amount in said players' pot, less a house rake, if any, to the player having the highest poker and;

(c) if no player has a poker hand whose value is three-of-a-kind or better, the wagers comprising said players' pot are retained and form part of the players' pot in the succeeding hand; and (d) the dealer paying a premium to each player whose hand comprises a straight or better.

2. The method of claim 1 wherein the dealer collects a payment from each player who discards one card.

3. The method of claim 1 wherein said house rake comprises 3.3 percent of said common pot.

4. The method of claim 1 wherein the initial five card hands are dealt to each player five-at-a-time.

5. The method of claim 1 wherein said predetermined wager in the first betting zone is five dollars.

6. The method of claim 1, further including:

providing an opportunity for the dealer to discard one card and utilize said common card, subject to the following conditions:

a) if the dealer's initially-dealt hand is a straight or better, the dealer may not discard and utilize said common card;

b) if the dealer's initially-dealt hand comprises four cards to a flush, the dealer must discard the odd card and utilize said common card;

c) if the dealer's initially-dealt hand comprises four cards to a straight, the dealer must attempt to complete said straight by discarding one card and utilizing said common card; and d) in situations other than those set out at a, b and c, above, the dealer must discard the lowest unmatched card and utilize said common card.

7. The method of claim 6 wherein the dealer's initially-dealt hand comprises four cards to a straight further comprising:

if the dealer's initially-dealt hand comprises four cards in sequence and one card not in sequence, the dealer must discard the card which is not in sequence and use the common card; and if the dealer's initially-dealt hand comprises five cards of a sequence selected from: X+(X+1)+(X+2)+(X+4)+(X+5); or X+(X+1)+(X+3)+(X+4)+(X+5), where X is the lowest-value card, the dealer must discard card X and utilize the common card.

8. A method of playing a modified draw poker game comprising:

providing a table having a playing station for a dealer and playing stations for a plurality of players, each player station comprising a card playing area;

betting areas on said table having first and second betting zones for each player;

each player placing a predetermined wager in said first betting zone;

the dealer dealing an initial, five-card hand, face down, to himself and to each player;

the dealer placing a common card, face down, at a location on the table;

providing an opportunity for each player to fold or stay, each player who folds forfeiting the wager in said first betting zone to dealer, and each player who stays placing a second wager in the player's second betting zone, said wagers in the second betting zone comprising a players' pot;

providing an opportunity for each player to discard one card and to utilize said common card to improve his or her poker hand;

turning all cards to a face up position:

(a) the dealer paying an amount equal to the wager in said first betting zone to each player who has a higher poker hand than dealer, and collecting the wagers in said first betting zone from each player having a lower poker hand than dealer;

(b) if one or more players has a poker hand whose value is three-of-a-kind or better, the dealer paying the amount in said players' pot, less a house rake, if any, to the player having the highest poker and;

(c) if no player has a poker hand whose value is three-of-a-kind or better, the wagers comprising said players' pot are retained and form part of the players' pot in the succeeding hand; and (d) the dealer paying a premium to each player whose hand:

i) comprises a straight or better, and ii) is higher in value than that of the dealer.

9. A gaming table for a casino poker game comprising:

a recessed area in said gaming table for a dealer's playing station:

a plurality of players' stations disposed around a generally arcuate section of said gaming table, each player's station having a card playing area and a betting area, said betting area comprising:

a) a first betting zone and a second betting zone marked on said table in front of each player;

b) a discard area marked on said table in front of each player; and c) a marked area adjacent said dealer's playing station for holding accumulated undistributed wagers from hand to hand.

* * * * *